US009004744B1

(12) United States Patent
Kemp

(10) Patent No.: US 9,004,744 B1
(45) Date of Patent: Apr. 14, 2015

(54) FLUID MIXER USING COUNTERCURRENT INJECTION

(75) Inventor: David M. Kemp, Powder Springs, GA (US)

(73) Assignee: Techni-Blend, Inc., Waukesha, WI (US)

( * ) Notice: Subject to any disclaimer, the term of this patent is extended or adjusted under 35 U.S.C. 154(b) by 1129 days.

(21) Appl. No.: 12/750,191

(22) Filed: Mar. 30, 2010

Related U.S. Application Data

(60) Provisional application No. 61/164,688, filed on Mar. 30, 2009.

(51) Int. Cl.
*B01F 15/02* (2006.01)
*B01F 5/10* (2006.01)

(52) U.S. Cl.
CPC ..... *B01F 5/108* (2013.01)

(58) Field of Classification Search
CPC ..... B01F 5/045
USPC ..... 366/167.1, 173.1, 173.2, 174.1, 175.2, 366/182.4; 426/477
See application file for complete search history.

(56) References Cited

U.S. PATENT DOCUMENTS 2,000,953 A * 5/1935 Hooker et al. ..... 366/339
3,606,272 A * 9/1971 Bergstedt ..... 366/172.1
3,648,985 A * 3/1972 Matweecha ..... 366/107
4,022,119 A * 5/1977 Karr ..... 99/275
4,068,010 A * 1/1978 Karr ..... 426/477
4,241,877 A * 12/1980 Hughes ..... 239/405
4,374,813 A * 2/1983 Chen et al. ..... 423/243.08
4,416,194 A * 11/1983 Kemp ..... 99/275
4,484,937 A * 11/1984 James et al. ..... 96/234
4,489,746 A * 12/1984 Daghe et al. ..... 137/218
4,669,889 A * 6/1987 Yamaguchi et al. ..... 366/160.2
4,715,393 A * 12/1987 Newton ..... 137/7
4,795,061 A 1/1989 Peckjian
4,807,783 A 2/1989 Van Zijverden
4,865,817 A * 9/1989 Burgess et al. ..... 422/168
4,963,329 A * 10/1990 Burgess et al. ..... 422/168
5,023,064 A * 6/1991 Burgess et al. ..... 423/243.08
5,176,448 A * 1/1993 King et al. ..... 366/174.1
5,183,335 A * 2/1993 Lang et al. ..... 366/162.4
5,192,517 A * 3/1993 Spink ..... 423/243.08
5,299,715 A 4/1994 Feldman
5,316,180 A 5/1994 Cleland
5,362,464 A * 11/1994 Burgess et al. ..... 423/243.08
5,379,650 A * 1/1995 Kofoed et al. ..... 73/861.52
5,549,222 A 8/1996 Schroeder
5,570,822 A 11/1996 LeMarbe et al.
5,778,761 A 7/1998 Miller
5,829,639 A 11/1998 Horner et al.
5,947,597 A * 9/1999 King ..... 366/181.5

(Continued)

*Primary Examiner* — David Sorkin
*Assistant Examiner* — Abbas Rashid
(74) *Attorney, Agent, or Firm* — Boyle Fredrickson, S.C.

(57) ABSTRACT

A method and apparatus for mixing fluids, such as beverage syrup and water, uses countercurrent injection to improve blending of the fluids. A mixing chamber has a first inlet through which a first fluid is fed to the mixing chamber, and a second inlet through which a countercurrent injection nozzle extends and is operative to inject a second fluid into a stream of the first fluid. The countercurrent injection nozzle is equipped with a check valve to control the flow of fluid into the mixing chamber. The mixing chamber may include additional inlets that may be fitted with countercurrent injection nozzles to permit the countercurrent injection of other fluid, such as flavorings, into the stream of the first fluid.

4 Claims, 5 Drawing Sheets

(56) References Cited

U.S. PATENT DOCUMENTS

| | | | | |
|---|---|---|---|---|
| 6,027,241 | A * | 2/2000 | King | 366/181.5 |
| 6,076,955 | A * | 6/2000 | Wallther | 366/163.2 |
| 6,224,778 | B1 * | 5/2001 | Peltzer | 210/739 |
| 6,276,823 | B1 * | 8/2001 | King | 366/181.5 |
| 6,422,735 | B1 * | 7/2002 | Lang | 366/162.4 |
| 6,599,546 | B2 * | 7/2003 | Palaniappan | 426/231 |
| 6,865,957 | B1 * | 3/2005 | Hughes et al. | 73/861.52 |
| 6,868,990 | B2 | 3/2005 | Cater et al. | |
| 6,892,899 | B2 | 5/2005 | Minard et al. | |
| 7,159,743 | B2 | 1/2007 | Brandt et al. | |
| 7,404,337 | B2 * | 7/2008 | Hughes et al. | 73/861.52 |
| 7,484,425 | B2 * | 2/2009 | Hughes et al. | 73/861.52 |
| 2001/0055242 | A1 * | 12/2001 | Deshmukh et al. | 366/341 |
| 2002/0149995 | A1 * | 10/2002 | Lang | 366/162.4 |
| 2002/0170617 | A1 * | 11/2002 | Veenstra et al. | 141/94 |
| 2003/0072213 | A1 * | 4/2003 | Cocoli | 366/173.1 |
| 2004/0084475 | A1 | 5/2004 | Bethuy et al. | |
| 2004/0246813 | A1 * | 12/2004 | Lang | 366/162.4 |
| 2006/0042399 | A1 * | 3/2006 | Hughes et al. | 73/861.52 |
| 2007/0157738 | A1 * | 7/2007 | Hughes et al. | 73/861.52 |
| 2008/0029541 | A1 | 2/2008 | Wallace et al. | |
| 2008/0047973 | A1 | 2/2008 | Elsom et al. | |
| 2010/0031825 | A1 * | 2/2010 | Kemp | 99/275 |

* cited by examiner

FLUID MIXER USING COUNTERCURRENT INJECTION

CROSS-REFERENCE TO RELATED APPLICATION

This application claims the benefit of U.S. Ser. No. 61/164,688 filed Mar. 30, 2009, the disclosure of which is incorporated herein.

FIELD OF INVENTION

The present invention is directed to blending systems and, more particularly, to a method and system of blending fluids using countercurrent injection.

BACKGROUND AND SUMMARY OF THE INVENTION

Liquid blending systems, such as those used to mix beverage syrup and water, typically introduce a stream of beverage syrup and a stream of liquid such as water to a mixing chamber. In the mixing chamber, the syrup and the liquid mix with one another to provide a partially blended beverage. The partially blended beverage typically then flows to a static diffuser, which functions to fully blend the beverage. One type of diffuser includes a series of plates in a stacked arrangement. The partially blended beverage is radially expanded by the surface of the plates, and the spaced arrangement of the plates causes a cascading effect of the beverage through the diffuser. The beverage is subjected to an expanding and shearing process as it passes through diffuser, which ultimately results in a fully blended beverage.

One of the drawbacks of conventional beverage blending systems is the lack of blending that occurs within the mixing chamber upstream of the diffuser. That is, most of the mixing of the beverage syrup and the liquid occurs at the static diffuser rather than from the introduction of beverage syrup to the flow of liquid, or vice-versa. While there may be some dispersion of the beverage syrup into the stream of liquid, or vice-versa, for the most part, these separate components remain relatively separate from one another until presented to the diffuser, which can result in a syrup slug being presented to the diffuser. While the diffuser will expand the slug and provide a certain amount of blending, it is possible for the slug to overwhelm the diffuser and result in a poorly blended beverage.

Poor mixing of syrup and liquid can result in an incorrect ratio of syrup to liquid medium. In the past, any such imbalances have been accounted for by passing the syrup and liquid through an averaging tank. While this functions satisfactorily to even out liquid/syrup ratios, it involves an added piece of equipment that requires installation and maintenance, as well as an additional step in the process.

In addition, conventional blending systems have utilized pump control to regulate the flow of syrup and liquid along respective supply conduits to the mixing chamber. Nipple valves are usually provided at the dispensing ends of each supply conduit. When the pumps are shut off at the end of a dispensing cycle, forced flow of syrup and liquid along the supply: conduits ceases. However, because of the density of the syrup, it is not uncommon for some syrup to leak out of the nipple valve into the mixing chamber. If the liquid medium is also leaked into the mixing chamber, the leakage of syrup would be less problematic. However, the less dense liquid medium typically does not leak past the nipple valve at the end of the liquid supply conduit. The introduction of residual of syrup to the mixing chamber can disturb the ratio of syrup and liquid in the mixing chamber when the dispenser is cycled back on.

The above-described lack of precision in controlling the amounts of syrup and liquid medium can be exaggerated when additional ingredients are added, such as flavoring or the like.

The present invention seeks to overcome the drawbacks of conventional blending systems by providing a blending system that uses countercurrent injection to improve the blending of a concentrate, such as beverage syrup, with a fluid medium, such as water. Introducing concentrate and fluid in opposed flows into a mixing area improves the dispersion or blending of concentrate in the liquid medium, which provides more efficient and better blending downstream, such as by a static diffuser.

Additionally, in one embodiment, respective check valves are used to control the flow of concentrate and liquid medium from respective supply conduits into the mixing chamber. The check valves provide improved performance against backflow and leakage.

The present invention also reduces the occurrence of syrup (or concentrate) slugs, provides consistent pre-diffuser distribution of concentrate, and eliminates the need for large averaging tanks typically required in beverage blending systems.

Therefore, in accordance with one aspect of the invention, a fluid mixing apparatus for mixing a first fluid and a second fluid is provided. The mixing apparatus includes a mixing chamber having an inlet and an outlet, with the inlet designed to pass a stream of the first fluid along a first flow direction. A countercurrent injection nozzle is disposed within the mixing chamber and is operative to inject the second fluid into the stream of the first fluid along a second flow direction that opposes the first flow direction. As the second fluid exits the countercurrent injection nozzle, the second fluid collides with the first fluid and causes turbulent flow of the two fluid components within the mixing chamber. This collision and turbulent flow causes immediate dispersion of the second fluid and, ultimately, distribution of particles of the second fluid within the first fluid.

In accordance with another aspect of the invention, a multistage blending system is provided, and includes a mixing chamber having a fluid inlet and a fluid outlet. The fluid inlet is configured to receive a primary fluid stream. The system further includes a plurality of spaced valve bodies arranged between the fluid inlet and the fluid outlet. A respective mixing volume is defined between successive valve bodies. Each mixing volume has a respective countercurrent injection nozzle that is configured to inject a secondary fluid into the primary fluid stream. Thus, within each mixing volume, the collision of the secondary fluid into the primary fluid stream is used to distribute the secondary fluid throughout the primary fluid stream.

The present invention may also be embodied in a method. Accordingly, another aspect of the invention includes a method of mixing a first fluid and a second fluid. The method includes introducing a first fluid into a mixing chamber having an outlet and introducing a second fluid into the mixing chamber along a flow path that opposes the flow path along which the first fluid flows within the mixing chamber toward the outlet.

It is therefore an object of the invention to provide a blending system providing improved blending.

It is another object of the invention to provide a blending system that does not include an averaging tank.

It is another object of the invention to provide a beverage blending system with reduced leakage of concentrate into a mixing chamber.

Other objects, features, aspects, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout.

In the drawings.

DETAILED DESCRIPTION

Figure 1:
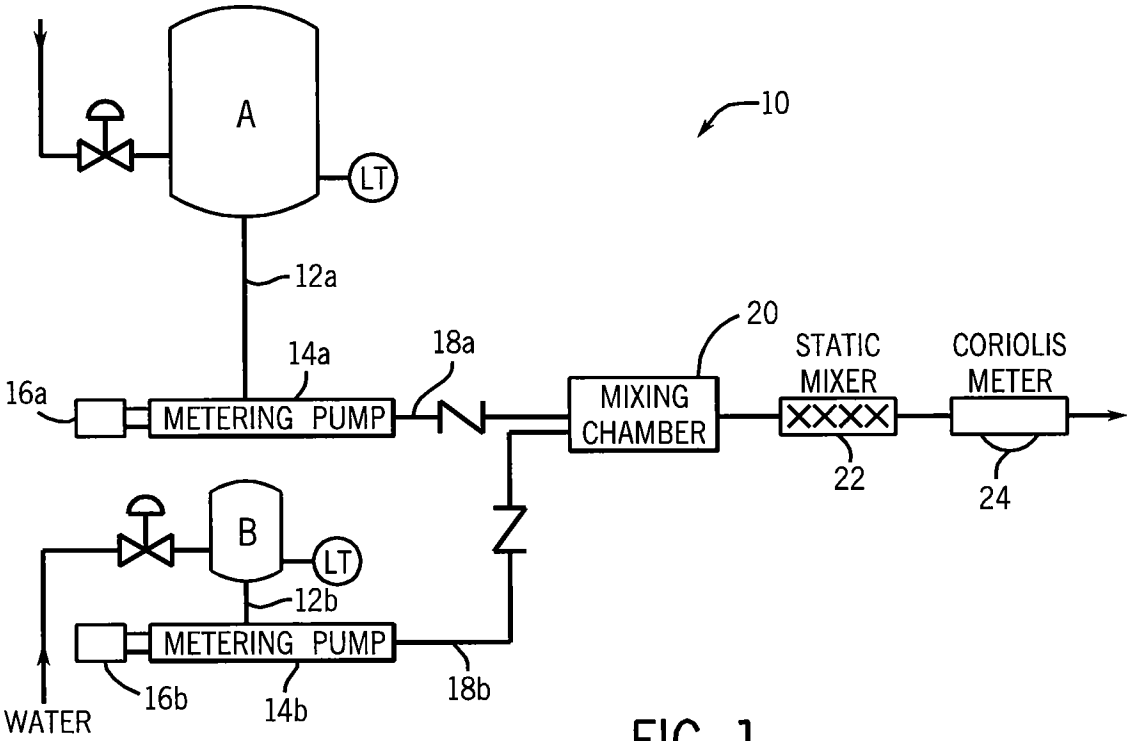
FIG. 1 is a is a schematic diagram of a blending system in a general application according to one embodiment of the invention.

FIG. 1 provides a general illustration of a blending system 10 according to one embodiment of the present invention. As shown in FIG. 1, a first liquid component is supplied from a source A, which may be a tank or reservoir (or alternatively may simply be a pipe that supplies the liquid component), and a second liquid component is supplied from a source B, which again may be a tank or reservoir (or alternatively may simply be a pipe that supplies the liquid component). The two liquid components are destined to be mixed or blended together to form a final, blended product.

From source A, the first liquid component is supplied through a line 12*a* to a metering pump 14*a*, which is driven by a motor 16*a*. Similarly, the second liquid component is supplied through a line 12*b* to a metering pump 14*b*, which is driven by a motor 16*b*. The metering pumps 14*a*, 14*b* function to accurately dispense desired quantities of the first and second liquid components according to a predetermined ratio. Representatively, the metering pumps 14*a*, 14*b* may be progressive cavity metering pumps, such as are available from any number of known manufacturers. The motors 16*a*, 16*b* that drive respective metering pumps 14*a*, 14*b* are preferably variable speed motors, e.g. servo-type motors. In a manner as is known, motors of this type can be carefully controlled so that the speed of operation can be constantly and almost instantaneously changed as desired, in response to input signals provided by a motor controller. In this manner, the operation of the metering pumps 14*a*, 14*b* can likewise be carefully controlled so that the output of each pump can be constantly and almost instantaneously varied as desired.

Metering pump 14*a* discharges to a line 18*a*, and metering pump 14*b* discharges to a line 18*b*. The lines 18*a* and 18*b* connect together at mixing chamber 20. As will be described more fully below, the mixing chamber blends the first and second liquid components using countercurrent injection. The mixing chamber 20 is upstream of a static mixer 22 and functions to mix or blend the two liquid components together, as will be described. The mixed or blended liquid then passes through a mass flow meter 24 that is downstream of mixer 22. In a manner as is known, the mass flow meter 24 may be a coriolis-type flow meter.

With the configuration as shown in FIG. 1 and described above, certain characteristics or parameters of the mixed or blended liquid can be measured by the mass flow meter 24 at a point immediately downstream of the location at which the liquid components are mixed together, and then compared to predetermined characteristics or parameters. In the event the measured characteristics or parameters are determined to be outside of acceptable ranges, a controller responsive to inputs from the mass flow meter 24 can adjust the speed of operation of motor 16*a* and/or motor 16*b* to alter the supply of one or both of the liquid components from pump 14*a* and/or pump 14*b*, to quickly bring the measured characteristics or parameters of the blended liquid within acceptable ranges.

The coriolis-type mass flow meter 24 functions to measure the volumetric flow, mass flow and density of the mixed or blended liquid. The flow volume is known from the output of the pumps 14*a* and 14*b*, and the density of the mixed or blended liquid can be determined using the mass flow meter data. Many typical applications require that the liquid density fall within an acceptable range and the present invention allows precise and nearly instantaneous control of this important parameter.

Figure 2:
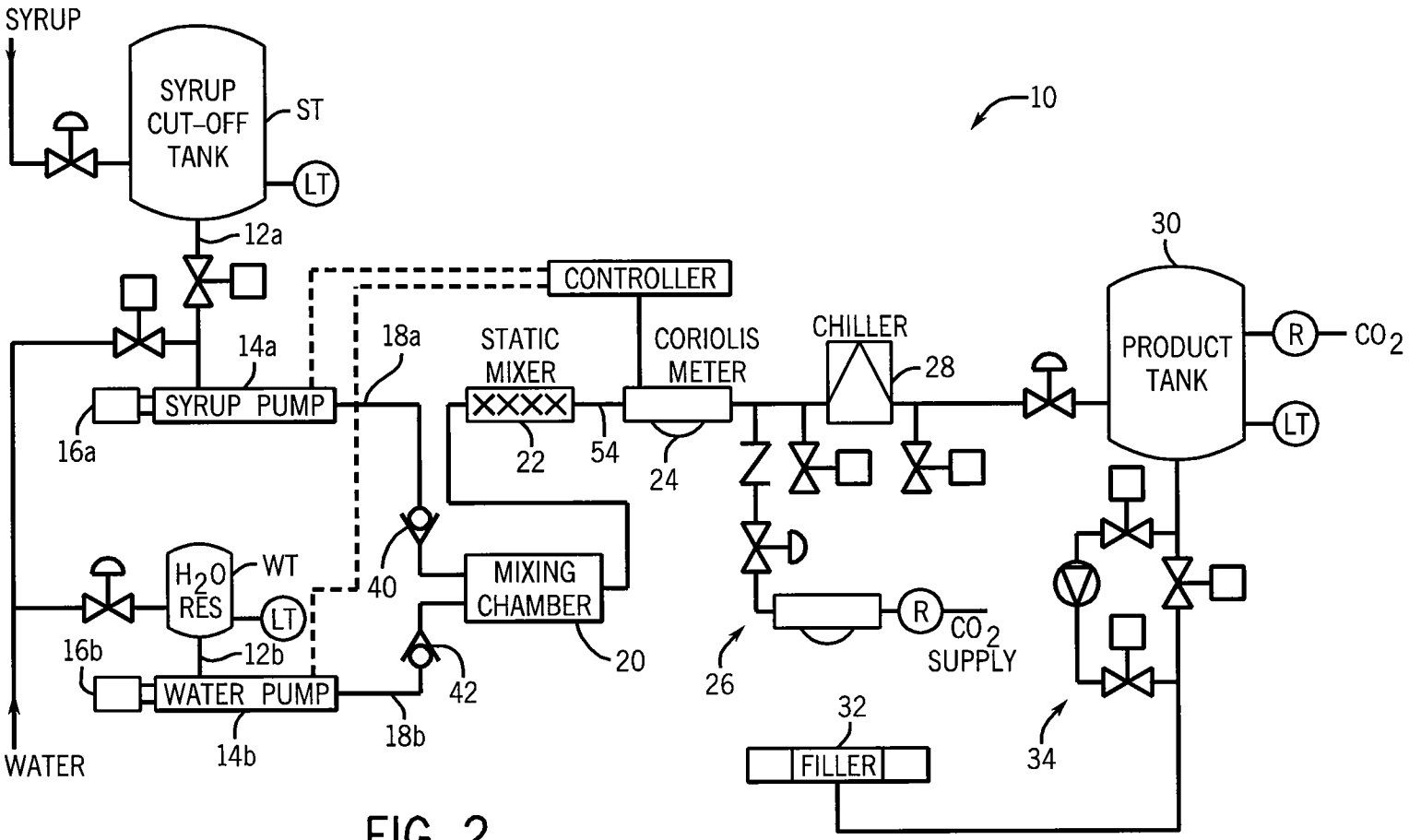
FIG. 2 is a schematic diagram of a blending system used to produce a product such as a soft drink that is formed of blended water and syrup according to the invention.
Figure 3:
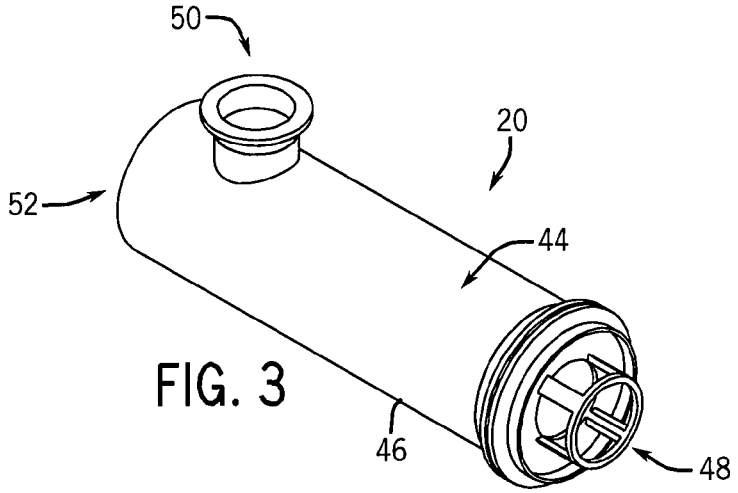
FIG. 3 is an isometric view of a mixing chamber incorporated in the blending system of FIGS. 1 and 2.

FIG. 2 illustrates a representative application of the system shown in FIG. 1. In this application, the blending system 10 is used to produce a product such as a soft drink that is formed of blended water and syrup. It should be understood that the application illustrated in FIG. 2 is representative of any number of different applications in which the system of FIG. 1 may be used to blend two or more liquids together to provide a blended liquid having certain predetermined characteristics.

In the representative system shown in FIG. 2, the first liquid A is in the form of syrup that may be supplied from a syrup tank ST to pump 14*a*. The second liquid B is in the form of water that may be supplied from a water tank WT to pump 14*b*. The syrup and water streams are supplied through lines 18*a* and 18*b*, respectively, to mixing chamber 20, where the syrup is counter injected into the stream of water. Countercurrent injection of the syrup into the water stream provides improved dispersion of the syrup in the water stream. As a result, when the mixed fluid is presented to the static mixer 22, the static mixer 22 provides more consistent blending. The mixed fluid then flows through the mass flow meter 24. The flow meter 24 functions to measure the volumetric flow, mass flow and density of the mixed syrup and water, to ensure that the ratio of syrup to water in the mixed stream is within an acceptable range. In this manner, adjustments can quickly be made in the flow rate of either the syrup or the water in the event there are variations in the density (concentration) of the syrup, so that the density (concentration) of the final product is relatively constant.

As also shown in FIG. 2, carbon dioxide may be injected into the mixed syrup and water at a location downstream of flow meter 24 using a conventional carbon dioxide supply system shown generally at 26. The carbonated liquid is then passed through a conventional chiller 28 and is supplied to a pressurized product holding tank 30. In a manner as is known, the carbonated liquid is then supplied to a filler 32 which functions to dispense the liquid into individual containers 34. An auxiliary booster pump and valve system 36 may be located between the holding tank 30 and the filler 32 in order to maintain a desired degree of pressure on the carbonated liquid during the filling operation. In an alternate embodiment, the carbon dioxide may be fed to the mixing chamber 20 via line 38 and preferably counter injected into the blended fluid.

In addition to pumps 14*a*, 14*b*, check valves 40, 42 are placed in lines 18*a*, 18*b*, respectively, to control the flow of syrup and liquid into the mixing chamber 20. In addition to preventing back flow, the check valves 40, 42 also reduce leakage, particularly of the relatively heavy (dense) beverage syrup, into the mixing chamber 20.

Referring now to FIGS. 3 through 7, in accordance with a preferred embodiment of the invention, the mixing chamber 20 has a generally cylindrical body 44 defined by an annular wall 46, a water inlet 48 that is flow-coupled to line 18*b* such as by a clamp (not shown), a beverage syrup inlet 50 that is flow-coupled to line 18*a*, such as by a clamp (not shown), and an outlet 52 that is flow-coupled to line 54 such as by a clamp (not shown), for example. The beverage syrup inlet 50 includes, or is otherwise flow-coupled to, a countercurrent injection nozzle 56 that is oriented to deliver the stream of beverage syrup into the stream of water. The countercurrent injection nozzle 56 has a nozzle body 57 defined by a generally annular wall 58 forming, in the orientation shown in FIG. 4, an upright portion 60, a horizontal portion 62, and an elbow portion 64 therebetween. The shape of the countercurrent injection nozzle body 56 is such that the fluid inlet 50 receives the beverage syrup along a velocity flow direction that is perpendicular to the velocity flow direction along which fluid exits the nozzle 56. In one embodiment, inlet 48 passes water whereas the countercurrent injection nozzle 56 injects beverage syrup into the stream of water passed through inlet 48.

Figure 4:
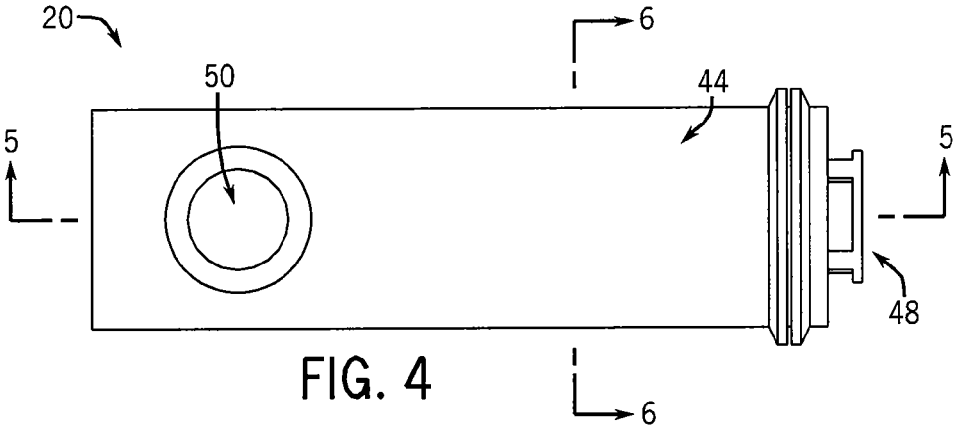
FIG. 4 is a top view of the mixing chamber of FIG. 3.
Figure 5:
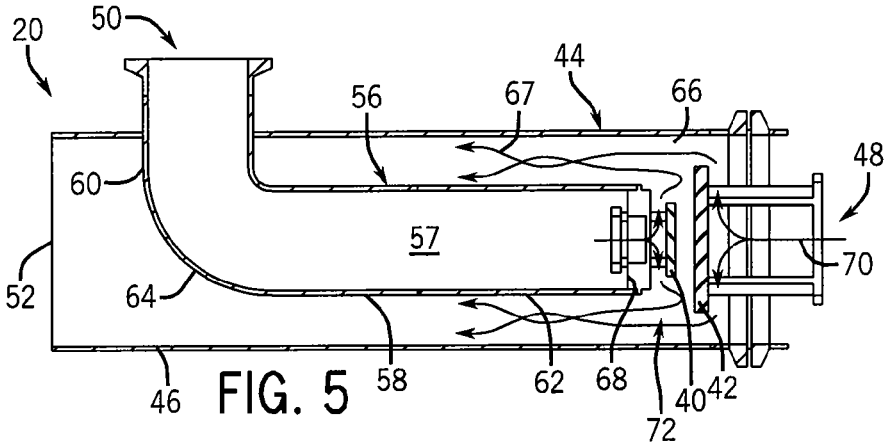
FIG. 5 is a section view of the mixing chamber taken along line 5-5 of FIG. 4.

As noted above, the flow of beverage syrup and liquid is controlled by respective check valves 40, 42. As shown in FIG. 4, check valve 40 is oriented generally adjacent the discharge end of the countercurrent injection nozzle 56. Check valve 42 is positioned in the inlet 48. The check valves 40, 42 effectively control the flow of water and syrup into the internal volume or mixing volume 66 of the mixing chamber 20. It is understood that the check valves 40, 42 can be of a known design. It should also be understood that other types of valve devices may be used to control the flow of fluid into the mixing volume 66.

Figure 6:
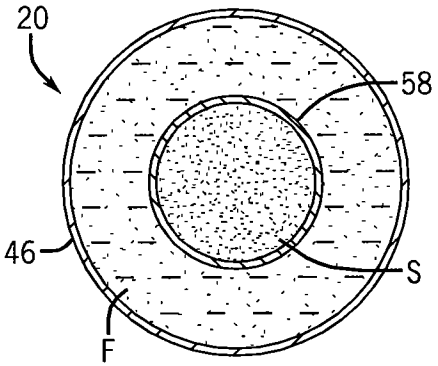
FIG. 6 is a section view of the mixing chamber taken along line 6-6 of FIG. 4.
Figure 7:
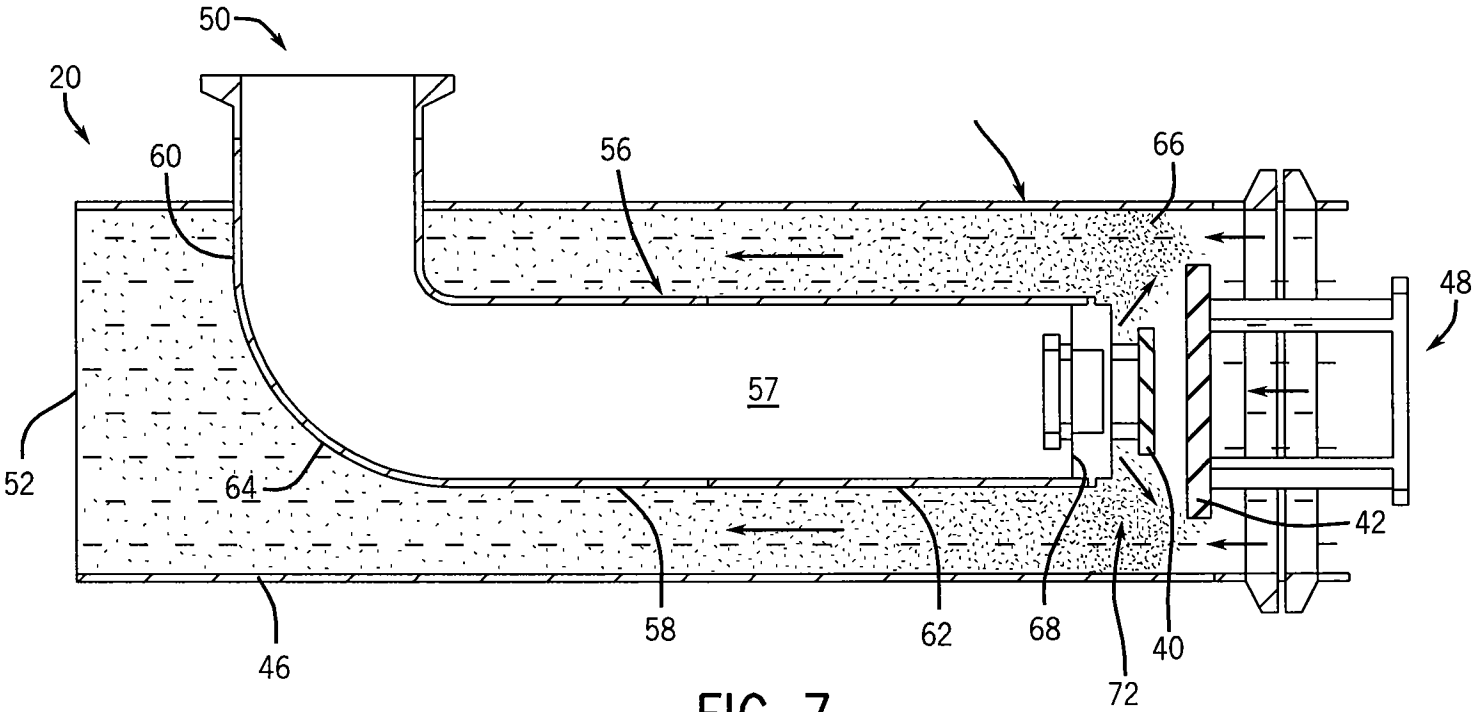
FIG. 7 is a section view of the mixing chamber illustrating the interaction between a first fluid and a counterinjected second fluid.

In one embodiment, the nozzle 56 is arranged such that its outlet 68 is centered about the velocity flow direction 70 along which fluid is presented to inlet 48. An injection zone 72 is defined between the outlet 68 of the nozzle 56 and the inlet 48. Fluid, e.g., beverage syrup, is expelled, i.e., "counterinjected", through outlet 68, once the check valve 40 is moved to an open position, and collides with fluid, e.g., water, that passes through the check valve 42 positioned at the inlet 50. This collision generally occurs at the injection zone 72. The force of the impact at the injection zone 72 causes turbulent flow of the mixed fluid components in the injection zone 72 such that the particles of the beverage syrup, S, disperse within the liquid, L, as illustrated in FIGS. 6 and 7. Additionally, the position of the nozzle 56 within the mixing volume 66 causes the mixed fluid 67 to pass between the exterior surface of the nozzle 56 and the inner wall of the mixing chamber 20 so that the mixing fluid 67 has a generally cone-shaped stream when it exists the mixing chamber 54.

It is understood that particles of the beverage syrup are dispersed within the liquid in the aforementioned cone-shaped stream, but the fluids may not be sufficiently "mixed" to meet with various blending requirements. For example, in the case of mixing syrup and water, while the countercurrent injection of syrup into a stream of water will disperse the syrup within the stream of water, additional mixing or blending may be needed to provide an appropriately blended beverage. As such, the cone-shaped stream may be presented to the static diffuser or mixer 22.

While additional blending or mixing of the cone-shaped stream may be needed, the countercurrent injection of the beverage syrup into a stream of liquid is believed to provide numerous advantages over conventional blending setups. For example, the present invention provides a substantially uniform or consistent distribution of the fluids. That is, there is not a significant separation of the beverage syrup from the liquid in the blended stream. The check valves provide relatively precise metering of the beverage syrup and the liquid, which is believed to reduce concentration spikes. Further, the use of check valves provides better control during periods of non-mixing. In conventional setups, as noted above, it is common for the heavier fluids to continue to fall into the mixing volume when the mixing process is stopped. This can result in a concentration slug that must be accounted for at resumption of the blending process, such as large averaging tanks, which the present invention does not require.

While the invention has been described with respect to the countercurrent injection of beverage syrup into a stream of water, the present invention may also be used for the countercurrent injection of water into a stream of beverage syrup. Thus, it will be appreciated that the invention could be used for the blending of first and second fluids wherein the second fluid is injected into a stream of the first fluid using a countercurrent injection nozzle to yield a cone-shaped blended stream. For example, the invention could be used to injected carbon dioxide, via the countercurrent injection nozzle 54, into a stream of water to provide a stream of carbonated fluid.

Figure 8:
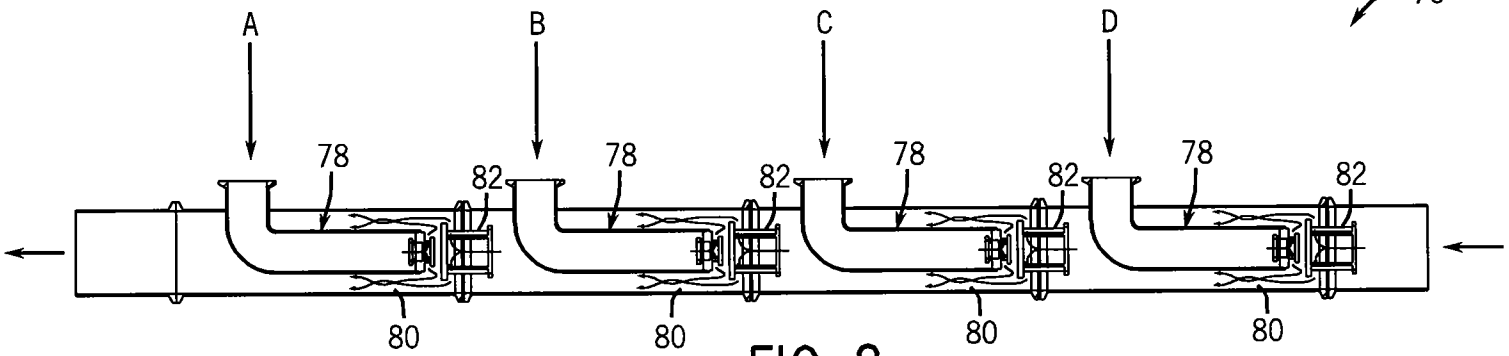
FIG. 8 is a section view of a mixing chamber having multiple countercurrent injection nozzles according to another embodiment of the invention.

As described above, in one embodiment, the invention provides a mixing chamber 20 that may be used to disperse a secondary fluid, e.g., beverage syrup, and a primary fluid, e.g., water. However, in accordance with another embodiment of the invention, multiple mixing chambers may be used to mix multiple secondary fluids with a primary fluid. For example, and referring to FIG. 8, an elongated mixing chamber 76 has a series of countercurrent injection nozzles 78 similar to injection nozzle 56 described above. Multiple mixing volumes 80 are defined along the length of the chamber 76. Each mixing volume 80 is defined between a pair of check valves 82, similar in construction and operation to check valve 42 described above. Each check valve 82 in effect defines the inlet into the next downstream mixing volume and the outlet for the preceding upstream mixing volume.

In the illustrated example, the mixing chamber 76 is designed to disperse four secondary fluids with a primary fluid. It is understood however that one or more of the secondary fluids may be the same fluid. It is also contemplated that one of the secondary fluids may have the same constituents of the primary fluid. In one example, the primary fluid (Ingredient A) may be filtered water, the first secondary fluid (Ingredient B) may be $CO_2$, the second secondary fluid (Ingredient C) may be beverage syrup, the third secondary fluid (Ingredient D) may be $CO_2$, and the fourth secondary fluid (Ingredient E) may be syrup. It will be appreciated that the above is just one example and that other mixing combinations may be used. In addition, for some applications, fewer than all of the countercurrent injection nozzles may be used.

The invention has been described with respect to a blending system designed to mix beverage syrup and carbonated water to form a blended soda that can be dispensed into a holding tank or similar container. However, it is understood that the invention may be used for blending beverages that are dispensed directly into a can, bottle, or similar container for later consumption. Additionally, it is understood that the invention could be used for blending of other fluids. For example, the invention could be used to blend water and gas to provide a liquid. In another example, the blending system may be used to blend a fluid, such as water, and one or more flavorings, so as to provide flavored water, flavored tea, and the like. Essentially, the invention may be used in any application in which two fluid components are to be mixed together.

Various modes of carrying out the invention are contemplated as being within the scope of the following claims, particularly pointing out and distinctly claiming the subject matter which is regarded as the invention.

I claim:

1. A fluid mixing apparatus for mixing a first fluid and a second fluid, comprising:

a supply conduit having a downstream end, wherein the first fluid flows within the supply conduit toward the downstream end;

a mixing chamber having a flow passage extending between an upstream end and a downstream end, wherein the upstream end of the mixing chamber is in communication with the downstream end of the supply conduit so as to receive the first fluid therefrom, and wherein a first check valve is located toward the upstream end of the mixing chamber and is configured to control the flow of the first fluid through the mixing chamber in a first direction toward the downstream end of the mixing chamber;

a countercurrent injection arrangement disposed within the flow passage of the mixing chamber between the upstream and downstream ends of the mixing chamber, wherein the countercurrent injection arrangement includes a fluid conduit disposed within the flow passage of the mixing chamber, wherein the fluid conduit defines an outlet located adjacent to and facing the first check valve, wherein the fluid conduit is arranged such that the second fluid flows within the fluid conduit toward the outlet in a second direction opposite the first direction, and wherein the countercurrent injection arrangement further includes a second check valve located at the outlet of the fluid conduit, wherein the second fluid is discharged directly from the second check valve into the first fluid within the first fluid conduit in a direction non-parallel to the first direction, and wherein the second fluid mixes with the first fluid around the second fluid conduit as the mixed first and second fluids flow toward the downstream end of the mixing chamber; and a discharge conduit having an upstream end in communication with the downstream end of the mixing chamber;

wherein the mixed first and second fluids flow within the discharge conduit from the downstream end of the mixing chamber, and wherein the second check valve is located within the flow path of the mixed first and second fluids within the mixing chamber at a location downstream of the downstream end of the supply conduit and upstream of the upstream end of the discharge conduit.

2. The apparatus of claim 1 wherein the countercurrent injection arrangement is positioned within the mixing chamber and is configured such that a cone-shaped stream of mixed first and second fluids passes through the downstream end of the mixing chamber.

3. The apparatus of claim 1 wherein the first fluid comprises water and the second fluid comprises beverage syrup.

4. The apparatus of claim 1 wherein the first fluid comprises water and the second fluid comprises $CO_2$.

* * * * *